US007781384B2

(12) United States Patent
Kian et al.

(10) Patent No.: US 7,781,384 B2
(45) Date of Patent: Aug. 24, 2010

(54) LUBRICANT BASE FROM PALM OIL AND ITS BY-PRODUCTS

(75) Inventors: Yeong Shoot Kian, Kajang (MY); Ooi Tian Lye, Kajang (MY); Salmiah Ahmad, Kajang (MY)

(73) Assignee: Malaysian Palm Oil Board

( * ) Notice: Subject to any disclaimer, the term of this patent is extended or adjusted under 35 U.S.C. 154(b) by 993 days.

(21) Appl. No.: 10/986,298

(22) Filed: Nov. 12, 2004

(65) Prior Publication Data

US 2005/0112267 A1 May 26, 2005

(30) Foreign Application Priority Data

Nov. 20, 2003 (MY) ..... PI20034471

(51) Int. Cl.
*C10M 169/04* (2006.01)
*C10M 105/38* (2006.01)

(52) U.S. Cl. ..... 508/491; 508/216; 554/30; 426/601

(58) Field of Classification Search ..... 508/110, 508/491; 426/602

See application file for complete search history.

(56) References Cited

U.S. PATENT DOCUMENTS

| | | | | |
|---|---|---|---|---|
| 5,773,391 | A * | 6/1998 | Lawate et al. | 508/257 |
| 5,916,854 | A * | 6/1999 | Inaya et al. | 508/452 |
| 2002/0035043 | A1 * | 3/2002 | Yokota et al. | 508/485 |
| 2003/0068426 | A1 * | 4/2003 | Idris et al. | 426/601 |
| 2003/0186824 | A1 * | 10/2003 | Chiu et al. | 508/490 |

FOREIGN PATENT DOCUMENTS

EP 594320 A1 * 4/1994

* cited by examiner

*Primary Examiner*—Ellen M McAvoy
*Assistant Examiner*—Vishal Vasisth
(74) *Attorney, Agent, or Firm*—Dicke, Billig & Czaja, PLLC

(57) ABSTRACT

The invention relates to a biodegradable functional fluid composition based on vegetable oil. This functional fluid suitable for lubricant, hydraulic and like fluid comprises palm olein and its by-product generated from fractionation of palm oil. The by-product is esterified by a hindered alcohol prior to blend together with palm olein and additive packages. The hydraulic fluid particularly suited for tropical climate with temperature ranging from 15-40° C.

5 Claims, No Drawings

LUBRICANT BASE FROM PALM OIL AND ITS BY-PRODUCTS

FIELD OF THE INVENTION

The present invention relates to a biodegradable functional fluid composition for lubricant, hydraulic and like fluid, particularly a functional fluid based on palm oil and its by-products.

BACKGROUND OF THE INVENTION

In the recent years, there has been an increased awareness on the environmental impact of large amounts of lubricants and industrial fluids entering the environment due to leakage or spillage. If the lubricant has little biodegradability, accumulation of these lubricants will result in environmental pollutions.

The industrial lubricating oil currently in daily use largely based on mineral oils that are highly toxic to the environment. Mineral oils based lubricating oils are not readily biodegradable by microorganisms. Recent studies also indicate that these oils are carcinogenic. Consequently, there is an obvious need for lubricating fluids which are based on renewable natural resources, and at the same time environmentally friendly.

Vegetable oils are the potential candidates to replace conventional mineral oil based lubricating oils. Natural vegetable oils are non-toxic, exhibit a ready biodegradability, good lubricity and cause fewer health problems such as allergies. Rapeseed oils and sunflower oils are the two most common vegetable oils currently used in the formulation of biodegradable lubricants in Europe.

Meanwhile, the use of natural or modified vegetable oil as hydraulic fluid has been disclosed in several patents. Konishi et al. (U.S. Pat. No. 6,300,292) describes the use of rapeseed oil as a suitable base for hydraulic fluid. Honary (U.S. Pat. No. 5,972,855) used slightly modified soybean oil as a base oil to produce hydraulic fluid. Before this, the soybean oil is partially hydrogenated followed by a winterisation process. Lawate et al. (U.S. Pat. No. 5,538,645) used genetically modified high oleic vegetable oils as base fluid.

Transesterified oil is another group of base oil used by researchers in the formulation of environmentally acceptable hydraulic fluid. Kodali (U.S. Pat. No. 6,278,006) transesterified vegetable oil with a short chain fatty acid ester to produce a base suitable for industrial lubricant. Lamsa (U.S. Pat. No. 5,885,946) described a process of transesterifying vegetable oil with a lower alkanol to produce an alkyl ester and then the alkyl ester is further transesterified with a polyol. Lamsa (U.S. Pat. No. 5,885,946) provided a method for preparing a base for synthetic lubricant similar to U.S. Pat. No. 5,885,946 but using the enzymatic route.

Synthetic ester is yet another group of base fluid used. Hartley et al. (U.S. Pat. No. 6,054,420) described the preparation of a biodegradable lubricant or functional fluid using synthetic ester of polyhydric alcohol. Hartley et al. (U.S. Pat. No. 5,880,075) also described the use of the ester of oxoisodecyl alcohol with iso-stearic acid in combination with polyol ester in the preparation of synthetic biodegradable lubricant. Watanabe et al. (U.S. Pat. No. 5,607,907) disclosed the use of TMP (trimethylolpropane) esters of caprylic or capric acids adjusted with stearic acid as hydraulic fluid.

However, synthetic esters have the problem of higher prices and synthetic esters excellent in biodegradability have the disadvantage of being inferior oxidative stability. On the other hand, the vegetable oil which is excellent in biodegradability and superior in respect of lower prices, but they have poor thermal, oxidative and hydrolytic stability. In general, poor cold temperature properties of natural oil can be improved by increasing the degree of unsaturation in the natural oil. However high degree of unsaturation contributes to poor oxidative stability. For these reasons, the natural oils may only be used in the less severe applications. Rapeseed oil and castor oil, for instance, have been used in lubricants in limited specific applications.

Palm oil, even though possesses good biodegradability and lubricity and better oxidative stability compared to a highly polyunsaturated oil, is not chosen because of its poor cold temperature fluidity.

In order to improve on the properties of vegetable oils, the glycerine molecule of the vegetable oil can be substituted with a hindered alcohol. Usually alcohols without β-hydrogen, such as neopentyl glycol, trimethylol propane and pentaerythritol, are used. The vegetable oil is first hydrolysed to its fatty acids and glycerol. The hydrolysed fatty acids are then re-esterified with a hindered alcohol. This improves the thermal, oxidative and hydrolytic stability of the oil significantly without affecting much on the biodegradability. This new range of product is generally known as synthetic ester.

SUMMARY OF THE INVENTION

Lubricant helps to reduce friction between two contacting metal surfaces thus making the movement easier. In the absence of lubricant, friction caused by the rubbing of the moving parts causes wear and creates heat which welds tiny imperfections on the moving parts together. The parts then tear apart, weld together again, and so on. If allowed to continue will soon cause failure of the engine.

We have now found that vegetable oil and palm oil by-products which are biodegradable are possible to provide satisfactory high performance as a functional fluid.

An object of the present invention is to provide a competitively priced vegetable based functional fluid which possesses good biodegradability, oxidative stability and lubricating properties.

A further object of the present invention is to prepare a functional fluid having properties which are suitable to be used as hydraulic fluid. This fluid is prepared from a vegetable source, mainly palm oil together with palm oil derivatives. The palm oil is used either in its natural state after undergoing physical refining and fractionation or as derivatives after undergoing chemical modification. Combination of natural oil and derivatives can also be used. The said palm oil derivative is a polyol ester which resulting from chemical reaction between palm oil by-products and hindered polyol and the amount of polyol ester used in the disclosed lubricant composition is at least 30% by weight.

The combination of natural oil and the said polyol ester is also used and preferred. The resultant properties from this type of combination gave better properties due to the synergetic effect. One of the advantage is the resultant oil have a lower pour point and better oxidative stability than the natural vegetable oil. Moreover it is a good balance between performance and cost. Functional fluid of the invention can be formulated with one or more additives to enhance the performance of lubricant or hydraulic fluid. Examples of additives for hydraulic fluid include antioxidants, anti-foam additives, anti-wear additives, anti-rust additives, pour point depressants, viscosity-index improver or combinations thereof.

DETAILED DESCRIPTION OF THE INVENTION

This functional fluid could be used as base for lubricant such as the hydraulic fluid to facilitate the movement of construction, industrial or agriculture mechanism such as tractor, soil excavator, agricultural harvesting machine, injection moulding machine, hydraulic elevator, etc.

The base fluid use in this invention is palm olein. Palm olein is a liquid fraction obtained when the crude palm oil is fractionated and refined into solid and liquid fractions. Fractionation is performed in order to reduce the content of saturated fatty acids. Typically palm olein has Iodine Value (IV) in the range from about 56 to 72. A vegetable oil has IV higher than 72 could also be used in present invention. Iodine Value is an indication of the degree of unsaturation. Palm olein has been widely used, particularly, as edible oil in many countries, particularly for industrial frying.

It is well known that the palm olein of lower IV becomes cloudy as the temperature drops. This is due to crystallisation of some of the molecules within the palm olein, particularly the saturated triglycerides.

Preferably, the palm olein having IV (iodine value) of 60 or higher, high in tocopherol and tocotrienol content (800 to 1500 ppm), low in free fatty acid (FFA) (<0.5%), high oleic (46%) and low linoleic and linolenic (16%) content is used in this invention. Thus, the lubricant of the present invention is suitable to be used in tropical regions of countries such as Malaysia, Indonesia, Thailand, Singapore, Brazil or any other country with similar climate.

The said palm oil derivative is a polyol ester which resulting from chemical reaction between palm oil by-products and hindered polyol. The said palm oil by-product is a mixture of fatty acid having composition of 6 to 12 carbon with caprylic acid ($C_8$) and capric acid ($C_{10}$) as its major compounds. The caprylic acid is in the range of 40-60% while capric acid is about 20-47% of palm oil by-product.

This by-product could be obtained from the processing of palm oil. For example from the physical refining of palm kernel oil we could get the palm kernel fatty acid distillate (PKFAD) and from the oleochemical industry we could get the pre-cut fraction obtained from the splitting of palm kernel oil and the non-glyceride fraction recovered from the glycerol residue. The pre-cut fraction is expecially interesting because it is rich in $C_8$ and $C_{10}$ fatty acid.

The said hindered polyol does not contain β-hydrogen are neopentyl glycol, trimethylol propane, pentaerythritol and dipentylerythritol of fatty acids having 6 to 12 carbons. Preferably pentaerythritol is used in the present invention to esterify the fatty acids from palm oil by-product to form pentaerythritol ester.

Preferably synergy additive packages manufactured by Lubrizol™, L7653 and L7671A are added into the formulation of present invention to provide a superior result. L7653 provides a mixture of antiwears that is particularly useful. Antiwear additives absorb on metal, and provide a film that reduces metal-to-metal contact. Whereas, L7671A act as a thickener and pour point depressant to permit flow of the oil formulation below the pour point of the unmodified lubricant.

The hydraulic fluid is prepared by mixing the palm oil, polyol ester and additive packages until the admixture are homogenised. Other vegetable oils such as soybean, rapeseed and sunflower whether in its natural state or after chemical or genetic modification or physical refining to achieve a higher oleic content can also be used in the blend.

The hydraulic fluid in the present invention has viscosity index of at least 190. A lower viscosity index i.e. from 150-189 could also be obtained depending on the combination of the blend.

It is to be understood that the present invention may be embodied in other specific forms and is not limited to the sole embodiment described above. However modification and equivalents of the disclosed concepts such as those which readily occur to one skilled in the art are intended to be included within the scope of the claims which are appended thereto.

EXAMPLE 1

Preparation of Esters

The polyol ester used in the invention is prepared through esterification process in between palm oil by-product and a hindered polyol. The by-product is a short chain fatty acid mixture of $C_6$-$C_{12}$ fatty acids in which caprylic ($C_8$) and capric ($C_{10}$) acids as its major composition. Meanwhile, the hindered polyol is pentaerythritol (PE).

Pentaerythritol (1 mole) and fatty acids of $C_{8-10}$ mixtures (4.8 mol) was placed in a multinecked reactor for reaction. The reaction mixture was stirred with an overhead stirrer. The flask was charged with nitrogen gas before the reaction started and the reaction was carried out in the presence of a nitrogen blanket throughout the reaction. The esterification process was carried out at 140° C. to 210° C.

The progress of the reaction was monitored by measurements of both the acid content, amounts of water condensate collected in the Dean and Stark apparatus and thin layer chromatography (TLC). When the reaction has completed, the excess fatty acids was distilled over under reduced pressure. Pentaerythritol esters will remain in the flask.

Similarly other polyols such as neopentyl glycol, trimethylol propane and dipentaerythritol could also be used to prepare the polyol esters at different molar ratio.

EXAMPLE 2

Preparation of Blends

The lubricant is blended by mixing about 20 to 70% by weight of palm olein, at least 30% by weight of polyol ester and additives with a magnetic stirrer for 30 minutes at 50° C. until a homogeneous mixture is obtained.

The invention claimed is:

1. A base fluid lubricant composition comprising a homogenized mixture of:

(a) 20 to 70% by weight of palm olein, and (b) at least 30% by weight of polyol ester that the lubricant composition has a viscosity index of at least 150, wherein the polyol ester is derived from palm oil by-products and a hindered polyol that the palm oil by-products comprise a mixture of fatty acids having a composition of 6 to 12 carbons with 40% and 60% of caprylic acid and 20% to 47% of capric acid, and the palm oil by-products are palm kernel fatty acid distillate or precut fraction recovered from glycerol residue of a process splitting palm kernel oil.

2. The lubricant composition of claim 1, wherein the homogenized mixture is prepared by stirring palm olein and polyol ester at 50° C.

3. The lubricant composition of claim 1, wherein the palm olein has an iodine value not less than 60.

4. The lubricant composition of claim 1 further comprising at least one type of additives.

5. The lubricant composition of claim 1, wherein the at least one additive is any one or combination of anti-wear additive, thickener, or pour point depressant.

* * * * *